US005923250A

United States Patent [19]

Pildner et al.

[11] Patent Number: 5,923,250

[45] Date of Patent: Jul. 13, 1999

[54] SIZE DISCRIMINATING DUAL ELEMENT PIR DETECTOR

[75] Inventors: Reinhart K. Pildner; David McKenzie, both of Brampton, Canada

[73] Assignee: Digital Security Controls Ltd., Downsview, Canada

[21] Appl. No.: 08/789,386

[22] Filed: Jan. 28, 1997

[51] Int. Cl.[6] ..... G08B 13/18

[52] U.S. Cl. ..... 340/567; 250/342; 250/DIG. 1

[58] Field of Search ..... 340/567, 511, 340/522, 541, 565; 250/342, DIG. 1, 353

[56] References Cited

U.S. PATENT DOCUMENTS

| | | | |
|---|---|---|---|
| 4,746,910 | 5/1988 | Pfister et al. | 340/567 |
| 4,764,755 | 8/1988 | Pedtke et al. | 340/541 |
| 4,841,284 | 6/1989 | Biersdorff | 250/342 X |
| 4,849,635 | 7/1989 | Sugimoto | 340/567 X |
| 4,990,783 | 2/1991 | Muller et al. | 250/342 X |
| 5,453,733 | 9/1995 | Peterson et al. | 340/567 |
| 5,461,231 | 10/1995 | Sugimoto et al. | 250/342 |

FOREIGN PATENT DOCUMENTS

| | | |
|---|---|---|
| 0 218 055 | 4/1989 | European Pat. Off. . |
| 0 624 857 | 11/1994 | European Pat. Off. . |

*Primary Examiner*—Jeffery A. Hofsass
*Assistant Examiner*—Anh La

[57] ABSTRACT

A dual element PIR detector for a security system uses a series of beams in selected areas to limit the amount of radiation received from small domestic pets. A series of alternating beams define dead zones and the beams and dead zones provide size discrimination where a small domestic cat or other small pet does not have sufficient size to cause IR responses in two sensors sufficient to cause an alarm condition.

8 Claims, 5 Drawing Sheets

SIZE DISCRIMINATING DUAL ELEMENT PIR DETECTOR

FIELD OF THE INVENTION

The present invention relates to detectors for alarm systems, and in particular relates to detectors useful in discriminating between small pets and intruders.

BACKGROUND OF THE INVENTION

There are a host of different intruder alarm detection systems now on the market and many of these alarm systems are remotely monitored. In such systems, the detection of an alarm condition typically results in the alarm being reported to the police. Unfortunately, false alarms are a nuisance to the police forces and take them away from other important matters. One source of false alarms is caused by pets, and in particular small domestic pets. Screening of the lower ground level of the area being monitored is a common practice to reduce false alarms from pets, however, this approach is not effective for some small pets that have a tendency to climb. Domestic cats can cause problems for security systems.

The present invention seeks to overcome the problems of false alarms caused by small, domestic pets.

SUMMARY OF THE INVENTION

An infrared intrusion detector, according to the present invention, comprises a housing having two passive infrared (PIR) receiver arrangements where each passive infrared receiver arrangement includes a lens arrangement for focusing infrared (IR) radiation from predetermined zones within a space to be monitored. Each lens arrangement directs received radiation onto a PIR sensor, which produces a signal based on this received radiation. The detector has signal processing means connected to the sensors which processes the signals and evaluates the processed signals for sufficient IR radiation indicative of an alarm condition. The lens arrangements define alternating zones where one zone is associated with one PIR receiver arrangement and the next zone is associated with the other PIR receiver arrangement. Adjacent zones are separated by an upwardly narrowing nonactive zone which provides the detector with a vertical discretion characteristic. This detector provides for size discrimination of moving IR radiation sources within the monitored space and is able to reduce false alarms caused by pets.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
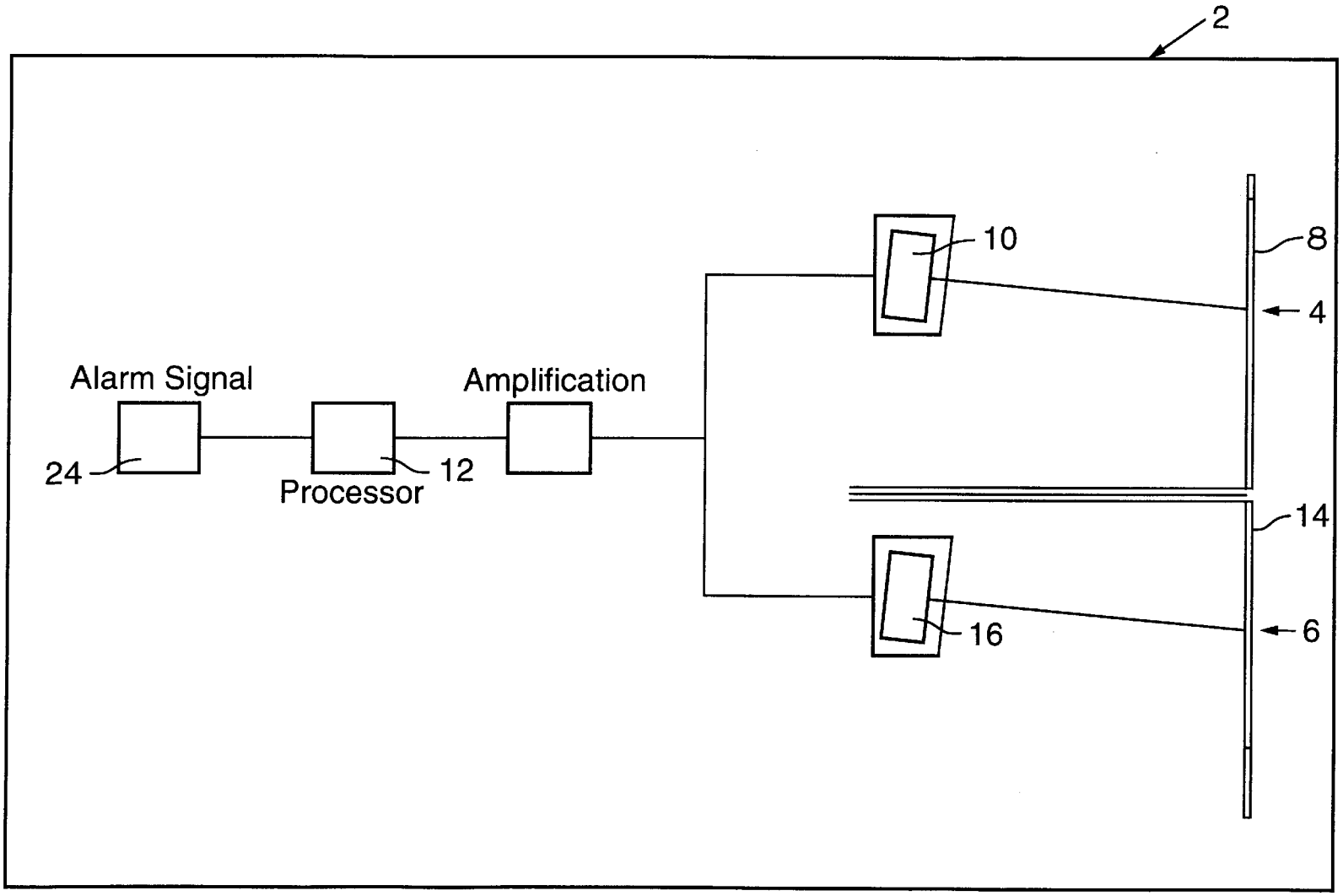
FIG. 1 is a schematic of an infrared intrusion detector.
Figure 5:
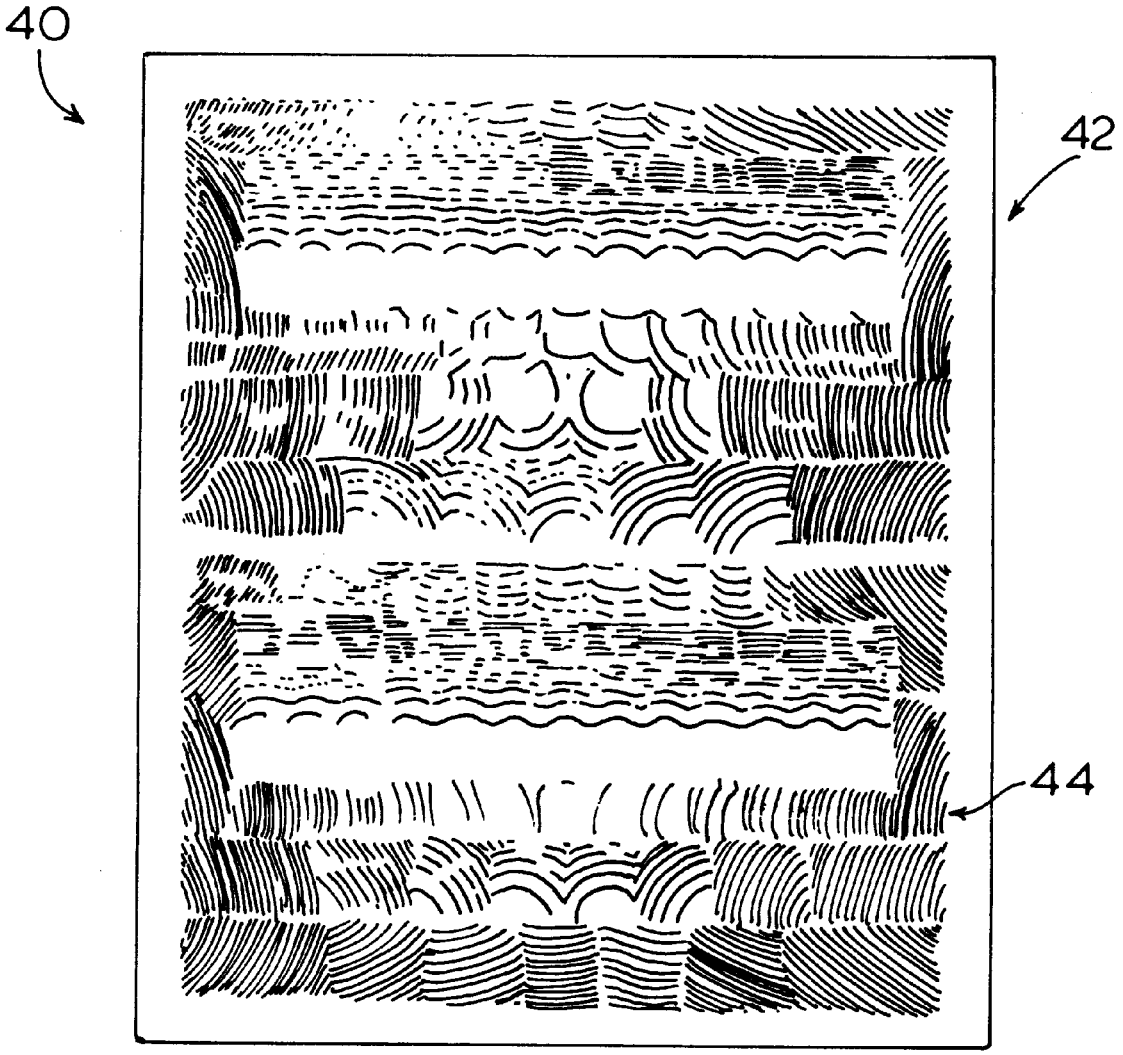
FIG. 5 is a front view of a flexible lens arrangement.

A dual element passive infrared detector 2 is shown in FIG. 1. The detector 2 has a housing 3 containing an upper PIR receiver arrangement 4 and a lower PIR receiver arrangement 6. The upper PIR receiver arrangement has a lens 8 which focuses selective infrared radiation from an area to be monitored 51 onto a sensor 10. The lower PIR receiver arrangement 6 also has a lens 14 which selectively focuses infrared radiation onto the sensor 16. An example of the combined lenses 8 and 10 is shown in FIG. 5.

The housing 3 has a back wall 5 for mounting to a wall of a premise at a raised position. Each of the sensors 10 and 16 are tilted forwardly approximately 6° to look downwardly. The signals from the sensors 10 and 16 are evaluated by the processor 12. An alarm signal is produced at 24 if the evaluation indicates an alarm condition.

Figure 2:
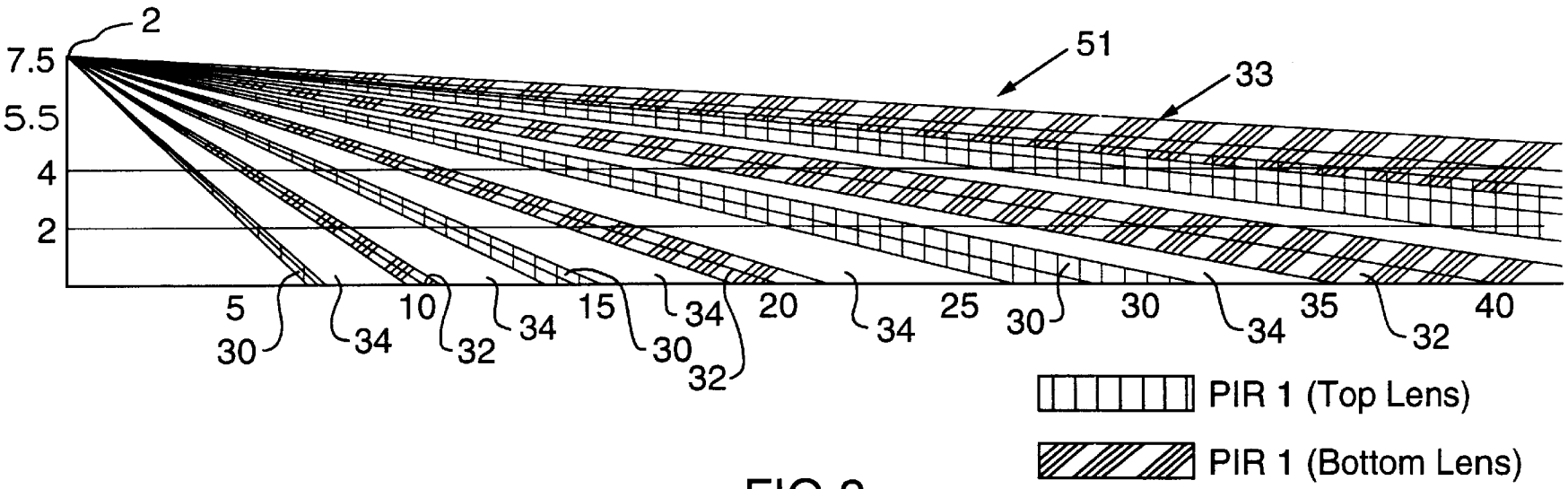
FIG. 2 is a schematic showing the beams of the detector.

FIG. 2 shows how the upper lens 8 and the lower lens 14 cooperate for monitoring of the area 51. The passive infrared detector 2 is shown mounted on a wall or similar structure at an elevation of approximately 7½ feet from the floor. The lens arrangement is looking forward and monitors the space 51. The distance grid along ground level is shown and it can be seen that two series of active zones 30 and 32 which alternate and are separated by a series of nonactive zones 34. The nonactive zones progressively narrow between active zones in a direction back towards the sensor. Zone 30 defines a response region where infrared radiation within the region is focused by the lens arrangement onto sensor 16. Infrared radiation within beams 32 is focused onto sensor 10. Infrared radiation in the nonactive zone is not focused on a sensor. The area from about five to forty feet from the base of the detector at ground level, is covered by the alternating series of zones 30 and 32. It can also be seen that the zones within about twenty-five feet of the sensor are relatively narrow and the nonactive zones define a considerable region, particularly within about two feet of ground level. With this spacing of the beams, a small pet, such as a domestic cat, is of a size less than approximately two feet in height and cannot cause sufficient infrared radiation to be received by both of the sensors 10 and 16 to produce an alarm. For example, a cat at twenty feet could be exposed to the beam 32 of the upper sensor 10, but the cat at ground level is not of sufficient size to also cause a high response in the active zone positioned at about fifteen feet where radiation will be focused on the sensor 16. It can also be seen that the active zones tend to diverge, however, there is still considerable spacing of the beams between two and three feet above ground level. The spacing between the active zones above the two foot level narrows, rendering this region more responsive to infrared radiation sources. In this way, the detector provides vertical discrimination.

The alternating zones 30 and 32 separated by the progressively narrowing nonactive zones produce vertical discrimination where the sensor within about twenty-five feet of the sensor is able to distinguish small domestic pets at ground level from larger and taller human intruders. Basically, the region within two feet of ground level and within twenty-five feet of the sensor is less responsive than a corresponding area above this two foot level. Small domestic pets have a large percentage of their volume normally in this lower region and false alarms from small domestic pets is reduced.

It can be seen that beyond approximately twenty-five feet, due to the divergence of the beams, the dead zone 34 between adjacent beams is becoming smaller. Fortunately, the amount of radiation received from a small domestic cat at these distances also decreases as a function of the distance. For this reason, the detector is not responsive to such a small infrared body, but would be responsive in a distance from six to approximately twenty feet if the upwardly narrowing nonactive zones were not present.

Figure 3:
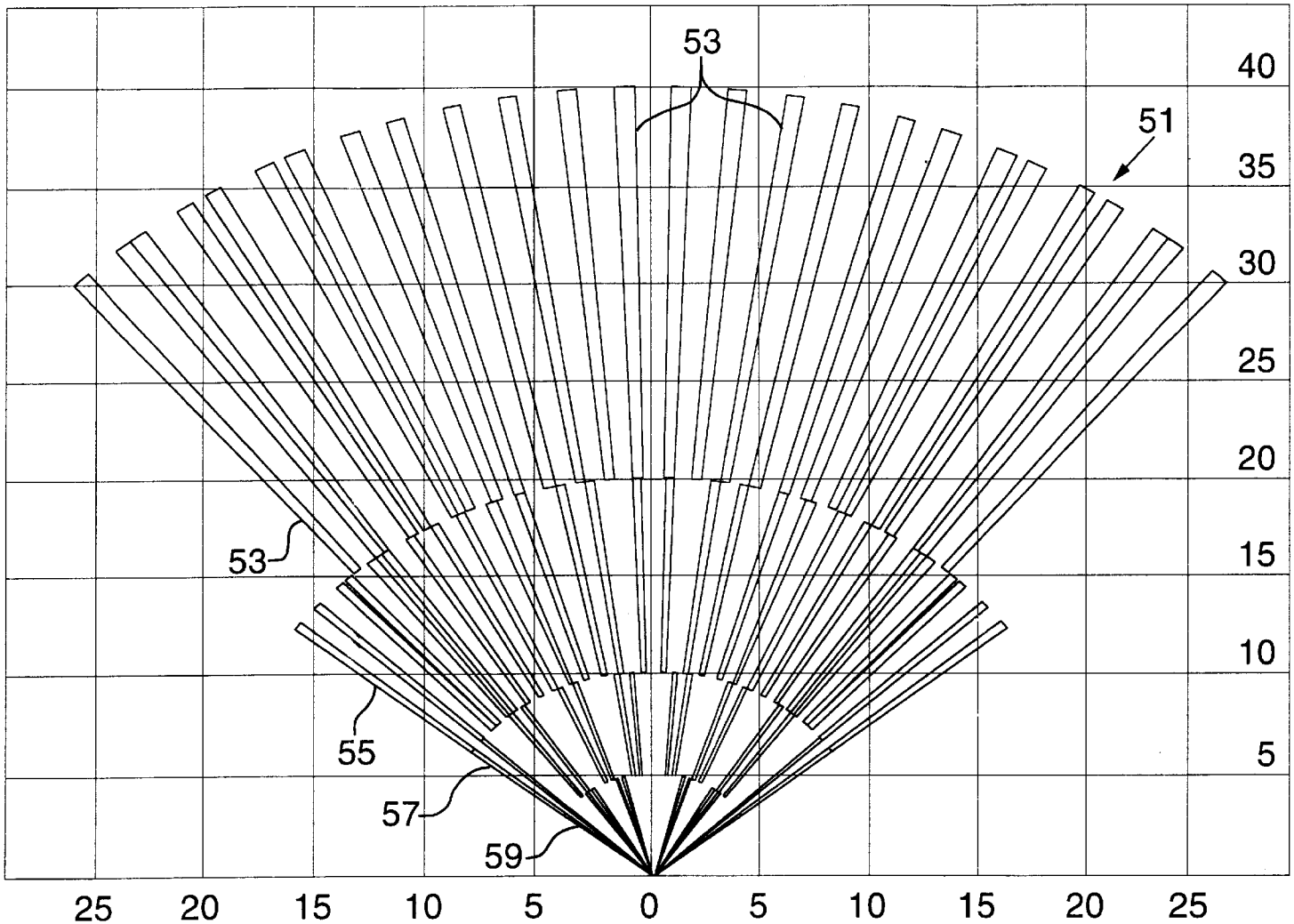
FIG. 3 is a top view showing various beams of the bottom passive infrared receiver arrangement of the detector.

FIG. 3 also illustrates how a pattern of zones is used to cover the space 51 being monitored. As shown in the sectional view of FIG. 4, there is a distant set of zones, generally indicated as 53, two intermediate sets of zones, indicated as 55 and 57, and a close series of zones 59. The exact position of these zones is determined by the Fresnel lens shown in FIG. 5. The lens 40 of FIG. 5 has an upper section 42 and a lower section 44. Each of the sections 42 and 44 are divided horizontally and vertically to cover different areas of the region, and thus, define the alternating active zones separated by the narrowing nonactive zones.

Figure 4:
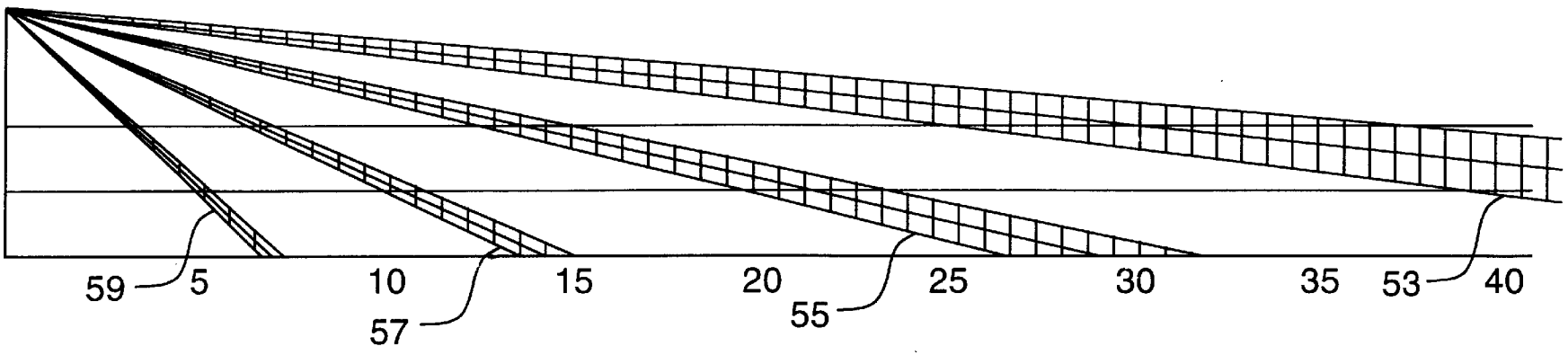
FIG. 4 is a side view showing various beams associated with the bottom passive infrared receiver arrangement.

A review of FIGS. 2 and 4 show how the response area of each zone 30 or 32 narrows as the distance from the detector decreases. This takes into account the higher levels of IR radiation received as the distance from the detector decreases.

The passive infrared detector has been described with respect to the benefits in discriminating small, domestic pets from human intruders. Cats have previously posed considerable problems, as they can climb and even though they are relatively small, they can enter an area substantially above ground level, resulting in the detector receiving a relatively high level of infrared radiation and resulting in an alarm condition. With the present invention, the area immediately adjacent the detector should be kept free of chairs or other objects which would allow a cat to establish itself at a high point in front of the detector. If the cat is at a low level, such as ground level or below about 2½ feet, it will cause considerable radiation to be received by one sensor, but the cat is not of sufficient size to cause a similar result in the other sensor. In contrast, a human intruder, due to the much greater size and height, will cause a high response in each sensor, causing an alarm to be produced.

The signals from the sensors 10 and 16 can be evaluated in a number of different ways. In the preferred form, each signal is evaluated at different amplitude levels and processed as described in U.S. Pat. No. 5,444,432, incorporated herein by reference. In this case, each signal is evaluated separately and an alarm signal is produced when both signals exceed a standard. Basically, the lens arrangement has rendered the area below two feet and within twenty-five feet of the detector less sensitive than a corresponding area above the two foot level. Other systems have tried to identify infrared radiation from pets and in contrast, the present invention reduces the possibility of receiving sufficient radiation from pets to cause an alarm.

A simple approach for evaluating the signals from the two sensors is to merely add the two results and then compare this result with a predetermined threshold. A small domestic animal, such as a cat, does not produce a response of sufficient magnitude in each sensor to cause it to exceed the alarm threshold. In contrast, an intruder, due to its size and normal vertical orientation, produces sufficient IR radiation to be immediately detected. This arrangement provides a simple approach for discriminating between different sizes of radiation sources. It has also been found that pets, such as dogs, of average size can also be discriminated in this way. It can be appreciated that the detector can also easily be adjusted for a particular application, if desired, by providing a variable threshold. In this case, depending upon the particular animals, thresholds can be set such that the animal does not cause an alarm while still being sensitive to a human intruder. A person can easily check this merely by setting the detector for the particular pet and then testing the system by entering the space himself and noting when a detection is made or using other test specimens, such as children. This arrangement provides a very efficient manner for size discrimination of moving IR radiation sources while still providing effective coverage of the space being monitored from unwanted intruders.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. An infrared intrusion detector comprising a housing having two PIR receiver arrangements, each PIR receiver arrangement including a lens arrangement which focuses IR radiation from predetermined zones within a space to be monitored onto a IR sensor which produces a signal based on received IR radiation, said intrusion detector having a signal processing means connected to said sensors which processes the signals and evaluates the signals and produces an alarm signal when necessary based on the evaluation of the signals, said lens arrangements defining two sets of alternating active zones where one set of active zones is associated with one PIR arrangement and the next zone is associated with the other PIR arrangement and wherein adjacent active zones are separated by a nonresponsive zone which reduces the response from a ground level region to infrared radiation from radiation sources of the size of a small domestic pet.

2. A detector as claimed in claim 1 wherein said zones alternate in a vertical direction.

3. A detector as claimed in claim 2 wherein said zones alternate and have nonactive zones therebetween at ground level within about forty feet of the detector.

4. A detector as claimed in claim 1 wherein within about twenty feet of said detector said zones are separated by nonresponsive zones and beyond about twenty-five feet and at a height of about four feet said zones overlap.

5. A detector as claimed in claim 2 wherein said zones also alternate in a horizontal direction.

6. A detector as claimed in claim 1 wherein said nonresponsive zones between ground level and two feet and within twenty-five feet of the detector are large relative to a corresponding zone above the two foot level.

7. An infrared intrusion detector as claimed in claim 1 wherein active zones are vertically separated with nonactive zones therebetween, said vertically separated active zones and said nonactive zones being arranged such that at ground level a domestic cat located anywhere between six and twenty feet from the detector has insufficient effect on adjacent active zones to have IR radiation therefrom and received by said two PIR receiver arrangement to satisfy a minimum value indicating an intruder is present.

8. A passive IR detector as claimed in claim 7 wherein said active and nonactive zones are sized such that a cat at ground level and within twenty-five feet of the detector has insufficient overlap between two adjacent zones such that the PIR receiver receives IR radiation from the cat at a level which is insufficient to produce an alarm signal.

* * * * *

US005923250C1

(12) EX PARTE REEXAMINATION CERTIFICATE (8012nd)

United States Patent
Pildner et al.

(10) Number: US 5,923,250 C1
(45) Certificate Issued: Feb. 8, 2011

(54) SIZE DISCRIMINATING DUAL ELEMENT PIR DETECTOR

(75) Inventors: Reinhart K. Pildner, Brampton (CA); David McKenzie, Brampton (CA)

(73) Assignee: Tyco Safety Product Canada, Ltd., Concord Ontario (CA)

Reexamination Request:
No. 90/010,071, Dec. 5, 2007

Reexamination Certificate for:

| | |
|---|---|
| Patent No.: | **5,923,250** |
| Issued: | **Jul. 13, 1999** |
| Appl. No.: | **08/789,386** |
| Filed: | **Jan. 28, 1997** |

(51) Int. Cl.
*G08B 13/191* (2006.01)
*G08B 13/189* (2006.01)

(52) U.S. Cl. ..... 340/567; 250/342; 250/DIG. 1
(58) Field of Classification Search ..... None
See application file for complete search history.

(56) References Cited

U.S. PATENT DOCUMENTS

| | | | |
|---|---|---|---|
| 3,958,118 | A | 5/1976 | Schwarz |
| 4,364,030 | A | 12/1982 | Rossin |
| 4,375,034 | A | 2/1983 | Guscott |
| 4,523,095 | A | 6/1985 | Keller-Steinbach |
| 4,704,533 | A | 11/1987 | Rose et al. |
| 4,734,585 | A | 3/1988 | Owers |
| 4,760,381 | A | 7/1988 | Haag |
| 4,772,797 | A | 9/1988 | Kahl et al. |
| RE32,828 | E | 1/1989 | Mudge |
| 4,849,635 | A | 7/1989 | Sugimoto et al. |
| 5,055,685 | A | 10/1991 | Sugimoto et al. |
| 5,134,292 | A | 7/1992 | Segawa et al. |
| 5,187,360 | A | 2/1993 | Pasco |
| 5,296,707 | A | 3/1994 | Nozu |
| 5,317,620 | A | 5/1994 | Smith |
| 5,414,255 | A | 5/1995 | Hampson |
| 5,461,231 | A | 10/1995 | Sugimoto et al. |
| 5,468,960 | A | 11/1995 | Sugimoto et al. |
| 5,572,033 | A | 11/1996 | Grant |
| 6,215,399 | B1 | 4/2001 | Shpater |

OTHER PUBLICATIONS

Crow Scientific Research, Genius High Performance Double Dual Element Passive Infrared Intrusion Detector Asic Technology for Higher Reliability, Electronic Engineering Ltd., Installation Instructions Rev. 2, Aug. 1995.
Burlary Tech Update, Security Sales, Feb. 1994.
Crow Electronic Engineering Ltd., Genius High Performance Double Dual Element Passive Infrared Intrusion Detector Asic Technology for Higher Reliability, Installation Instructions, Apr. 1999.
Security Distributing & Marketing, Feb. 1994, p. 50.
ISC West–Show Preview 1993, Conference Program.
Security Concepts, Mar. 1994, p. 24.
Crow Genius Advertising Brochure.

*Primary Examiner*—Deandra M Hughes

(57) ABSTRACT

A dual element PIR detector for a security system uses a series of beams in selected areas to limit the amount of radiation received from small domestic pets. A series of alternating beams define dead zones and the beams and dead zones provides size discrimination where a small domestic cat or other small pet does not have sufficient size to cause IR responses in two sensors sufficient to cause an alarm condition.

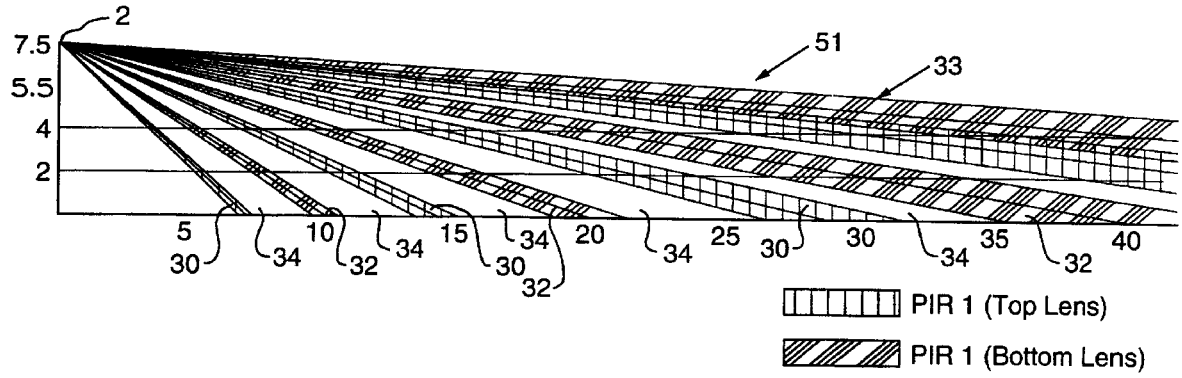

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is cancelled.

Claims 2, 4 and 6-7 are determined to be patentable as amended.

Claims 3, 5 and 8, dependent on an amended claim, are determined to be patentable.

2. [A detector as claimed in claim 1] *An infrared intrusion detector comprising a housing having two PIR receiver arrangements, each PIR receiver arrangement including a lens arrangement which focuses IR radiation from predetermined zones within a space to be monitored onto a IR sensor which produces a signal based on received IR radiation, said intrusion detector having a signal processing means connected to said sensors which processes the signals and evaluates the signals and produces an alarm signal when necessary based on the evaluation of the signals, said lens arrangements defining two sets of alternating active zones where one of set of active zones is associated with one PIR arrangement and the next zone is associated with the other PIR arrangement and wherein adjacent active zones are separated by a nonresponsive zone which reduces the response from a ground level region to infrared radiation from radiation sources of the size of a small domestic pet,* wherein said zones alternate in a vertical direction.

4. A detector as claimed in claim [1] *2,* wherein within about twenty feet of said detector said zones are separated by nonresponsive zones and beyond about twenty-five feet and at a height of about four feet said zones overlap.

6. [A detector as claimed in claim 1] *An infrared intrusion detector comprising a housing having two PIR receiver arrangements, each PIR receiver arrangement including a lens arrangement which focuses IR radiation from predetermined zones within a space to be monitored onto a IR sensor which produces a signal based on received IR radiation, said intrusion detector having a signal processing means connected to said sensors which processes the signals and evaluates the signals and produces an alarm signal when necessary based on the evaluation of the signals, said lens arrangements defining two sets of alternating active zones where one of set of active zones is associated with one PIR arrangement and the next zone is associated with the other PIR arrangement and wherein adjacent active zones are separated by a nonresponsive zone which reduces the response from a ground level region to infrared radiation from radiation sources of the size of a small domestic pet,* wherein said nonresponsive zones between ground level and two feet and within twenty-five feet of the detector are large relative to a corresponding zone above the two foot level.

7. An infrared intrusion detector as claimed in claim [1] *2,* wherein active zones are vertically separated with nonactive zones therebetween, said vertically separated active zones and said nonactive zones being arranged such that at ground level a domestic cat located anywhere between six and twenty feet from the detector has insufficient effect on adjacent active zones to have IR radiation therefrom and received by said two PIR receiver arrangement to satisfy a minimum value indicating an intruder is present.

* * * * *